US009759212B2

(12) United States Patent
Lingenfelter et al.

(10) Patent No.: US 9,759,212 B2
(45) Date of Patent: Sep. 12, 2017

(54) ELECTRONIC LOAD SENSE CONTROL WITH ELECTRONIC VARIABLE LOAD SENSE RELIEF, VARIABLE WORKING MARGIN, AND ELECTRONIC TORQUE LIMITING

(71) Applicant: DANFOSS POWER SOLUTIONS INC., Ames, IA (US)

(72) Inventors: Kevin R. Lingenfelter, Nevada, IA (US); Alex Bruns, Ames, IA (US); Christian Daley, Ames, IA (US); Vince Ewald, Ames, IA (US); Danny Wakefield, West Des Moines, IA (US)

(73) Assignee: Danfoss Power Solutions Inc., Ames, IA (US)

( * ) Notice: Subject to any disclaimer, the term of this patent is extended or adjusted under 35 U.S.C. 154(b) by 67 days.

(21) Appl. No.: 14/944,321

(22) Filed: Nov. 18, 2015

(65) Prior Publication Data

US 2016/0195083 A1 Jul. 7, 2016

Related U.S. Application Data

(60) Provisional application No. 62/099,612, filed on Jan. 5, 2015.

(51) Int. Cl.

| | |
|---|---|
| ***F15B 11/16*** | (2006.01) |
| ***F04B 49/22*** | (2006.01) |
| ***F04B 1/32*** | (2006.01) |
| ***F04B 49/06*** | (2006.01) |
| ***F04B 49/08*** | (2006.01) |

(52) U.S. Cl.

CPC ..... *F04B 49/22* (2013.01); *F04B 1/324* (2013.01); *F04B 49/065* (2013.01); *F04B 49/08* (2013.01); *F04B 2201/0204* (2013.01)

(58) Field of Classification Search

CPC ..... F15B 11/165; F15B 2211/6055; F04B 49/065

USPC ..... 60/420, 452

See application file for complete search history.

(56) References Cited

U.S. PATENT DOCUMENTS 5,267,440 A * 12/1993 Nakamura ..... E02F 9/2232 60/426
6,216,456 B1 4/2001 Mitchell
6,874,318 B1 * 4/2005 MacLeod ..... F04B 49/08 60/451

(Continued)

FOREIGN PATENT DOCUMENTS

CN 102734276 A 10/2012
EP 0087773 A1 9/1983

(Continued)

OTHER PUBLICATIONS

German Patent Office Search Report dated Dec. 2, 2016; German Application No. 102015225933.1; Danfoss Power Solutions Inc.

(Continued)

*Primary Examiner* — Thomas E Lazo
(74) *Attorney, Agent, or Firm* — Zarley Law Firm, P.L.C.

(57) ABSTRACT

An electrical pressure control load sense system having a pump connected inline to an operator control spool valve and a compensation circuit. The system also has a plurality of sensors, at least one pressure transducer, a micro-processor, a fixed orifice, a proportional pressure relief valve, and a swashplate angle sensor.

10 Claims, 9 Drawing Sheets

(56) References Cited

U.S. PATENT DOCUMENTS

| | | | | |
|---|---|---|---|---|
| 7,089,733 | B1 * | 8/2006 | Jackson | F15B 11/165 60/422 |
| 7,240,486 | B2 * | 7/2007 | Huang | F16D 31/00 60/413 |
| 7,854,115 | B2 | 12/2010 | Pack et al. | |
| 7,874,152 | B2 * | 1/2011 | Pfaff | E02F 9/2203 60/461 |
| 7,894,963 | B2 * | 2/2011 | Shenoy | E02F 9/2296 180/242 |
| 2012/0198832 | A1 * | 8/2012 | Fukumoto | F15B 11/162 60/459 |
| 2015/0159682 | A1 * | 6/2015 | Bae | F15B 11/0423 60/445 |

FOREIGN PATENT DOCUMENTS

| | | | |
|---|---|---|---|
| EP | 1696136 | A2 | 8/2006 |
| EP | 2554853 | B1 | 12/2015 |
| KR | 2012-0086061 | A | 8/2012 |
| WO | 2011/078578 | A2 | 6/2011 |
| WO | 2015140622 | A1 | 9/2015 |

OTHER PUBLICATIONS

CN102734276—Sany Automobile Hoisting Mach—English Abstract.

KR2012-0086061—Doosan Infracore Co., Ltd.—English Abstract.

Chinese Office Action issued by the State Intellectual Property Office (SIPO) dated May 31, 2017; Chinese Patent Application No. 201511025940.7; Danfoss Power Solutions Inc.

* cited by examiner

ELECTRONIC LOAD SENSE CONTROL WITH ELECTRONIC VARIABLE LOAD SENSE RELIEF, VARIABLE WORKING MARGIN, AND ELECTRONIC TORQUE LIMITING

CROSS-REFERENCE TO RELATED APPLICATIONS

This application claims priority to Provisional Application U.S. Ser. No. 62/099,612 filed on Jan. 5, 2015, which is incorporated by reference in its entirety.

BACKGROUND OF THE INVENTION

This invention is directed to an electronic control system that utilizes a variable load sense relief, variable working margins, and electronic torque limiting. The system includes an apparatus having sensors that detect pressure on opposite sides of a control valve that control hydraulic flow from a source to a hydraulic actuator. The sensors produce electrical signals indicating pressure. In response to the sensor signals, a controller produces an output signal which operates a proportional control valve to regulate pressure at a node of a hydraulic circuit.

Mechanisms that react to pressure at a node by varying pressure of the fluid being supplied to a main valve so that a controlled pressure level is achieved are known in the art. For one example of the state of the art, a mechanism uses pressure transducers and an Electronic Control Unit (ECU) to sense a load being applied to various machine functions. The ECU program monitors the pressure at several points in the circuit to optimize pump flow in relation to the speed demanded by the operator. Another example of the state of the art uses an electronic pressure control system having a proportional regulator that replaces a hydro-mechanical pressure limiter. The proportional relief valve acts on a pilot signal of a hydro-mechanical LS (load sense) regulator so that pump output pressure is proportional to a control current. Thus, the load sensing function is realized by an electronic control unit reading the instantaneous measurement of two pressure transducers, the first one on the pump outlet line and the second one on the valve LS port. An output current signal controls a proportional valve regulating the pump outlet pressure according to the instantaneous LS pressure. Yet another example of the state of the art uses embedded sensors to monitor pressure, displacement, speed, and temperature. The sensed data interacts with onboard electronics to help produce commanded functions including an integral proportional valve to position a pump's swashplate to produce flow and pressure outputs that control pump functions.

While these mechanisms have made improvements in the art, there are still problems associated with the load sensing system and the control of those systems that still exist. As an example, in applications where the pump is a long distance from the control spools, there can be difficulties associated with running high pressure hydraulic hoses from a control valve to a pump control. The length of the hoses cause response and stability problems for the entire system. Large overrunning loads, high inertia, or functions where the response is highly similar to the response of the pump can result in unstable operation.

To improve upon these problems use of electrical wires and a micro controller to replicate a load sense signal to a traditional pressure compensated load sense controlled pump would be beneficial. By electronically replicating the load sense signal at the pump the hydraulic load sense line may be removed which reduces cost. The addition of software can smooth circuit operation and eliminate previous instabilities inherent with traditional load sense systems. Also, by replacing the hydraulic signal with electrical lines and software permits pressure to be shifted from one direction to the other which provides a real variable working margin opportunity. Further, by adding an angle sensor to the system allows for a full variable electronic torque control to the system that further expands the capabilities of an open circuit variable axial piston pump.

Therefore, an objective of the present invention is to provide a load sensing control system that smooths circuit operation and eliminate instabilities inherent in traditional load sense systems.

Another objective of the present invention is to provide a load sensing control system that provides a full variable working margin.

A still further objective of the present invention is to provide a load sensing control system that removes a hydraulic load sensor line and reduce cost.

These objectives are merely a few of the objectives of the present invention and other objectives will be apparent to those of ordinary skill in the art based upon the following written description and drawings.

SUMMARY OF THE INVENTION

An electronic load sense control with electronic variable load sense relief, variable working margin and electronic torque limiting, having a pump that supplies pressurized fluid to an operator control spool valve and actuator. The pump is also connected in-line to a compensation spool valve and a load sense spool valve.

A first sensor is connected to the system to measure pump outlet pressure and a second sensor is connected to the system to measure pressure at load. The sensors are connected to a micro-processor having software logic.

The system also includes at least one pressure transducer, a proportional pressure relief valve, a fixed orifice, and a swashplate angle sensor. The load sense port of the pump is routed through the fixed orifice instead of the proportional pressure relief valve. Based upon sensed pressure from the first and/or second sensors, the micro-processor calculates a current that is sent to the proportional pressure relief valve. The proportional pressure relief valve then adjusts pressure to equal pressure sensed a load. The micro-processor can also add or subtract to the current based upon desired operating conditions. Finally, the micro-processor calculates an input torque and maximum pressure based in part on the swashplate angle.

DESCRIPTION OF THE PREFERRED EMBODIMENT

Figure 1:
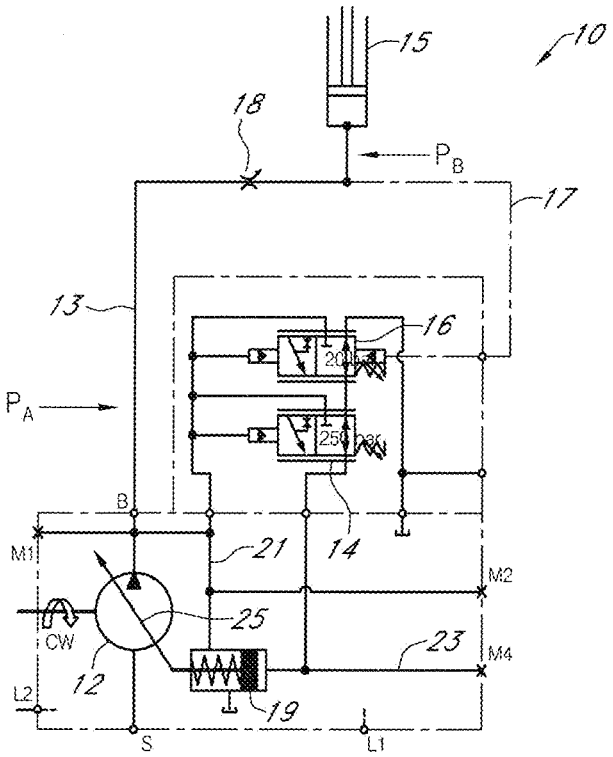
FIG. 1 PRIOR ART
FIG. 1 is a schematic view of a prior art pressure control load sense system.

FIG. 1 shows a traditional pressure control load sense system (PCLS) 10. By way of example only, the system 10 includes a pump 12 connected inline to a pressure compensation spool valve 14, a load sense spool valve 18. The pump 12 is of any type and preferably is a variable displacement pump. The pump provides pressurized fluid to the operator control spool valve 18 through flow line 13 associated with flow line 13 between pump 12 and valve 18 is a sensor (PA) for measuring pump outlet pressure.

From valve 18, fluid flows to cylinder or actuator 15 and pressure compensator spool valve 14 via flow line 17. Associated with flow line 17, between cylinder 15 and valve 14, is a sensor (PB) for measuring pressure at load. Fluid then flows from valves 14 and 16, depending on operating conditions, to a torque control valve 19 via flow lines 21 and 23. The torque control valve 19 controls displacement of swashplate 25.

When the pump outlet pressure (PA) exceeds the valve 14, fluid is routed by valve 14 via flow line 21 to destroke valve 25 and pump 12. For example, as shown in FIG. 1, valve 14 has a spring setting of 250 bar. When pump outlet pressure (PA) exceeds 250 bar, pressure compensator spool valve 14 is activated allowing fluid to flow to valve 25 and destroke the pump 12 until pump outlet pressure (PA) is equal to or lower than 250 bar.

The load sense spool 16 compares pump outlet pressure (PA) to pressure at the load pressure (PB) which is sensed after the operator control spool 18. The load sense spool 16 uses a spring to keep a constant difference between the pump outlet pressure (PA) and pressure at load (PB). The spring setting is added to pressure at load (PB) and the sum is kept equal to the pump outlet pressure (PA) by varying pump displacement. Hence, pump displacement varies to keep a constant pressure drop across the operator control spool 18. As an example only where the load pressure (PB) is equal to 200 bar, and the load sense spool spring setting is 20 bar, the load sense spool 16 ports oil to stroke the pump until the pump outlet pressure (PA) is 20 bar higher than the pressure at load (PB) so that (PA) is equal to 220 bar.

In this basic electronic load sense system 10 the resolved (highest) load pressure in the system 10 is measured and the resolved pressure is replicated at the load sense port of the pump 12. The maximum pump pressure is controlled by the pressure compensating spool 14 in the control, and the pump margin is controlled by the load sensing spool 16 spring setting. Both spools 14 and 16 remain in control of pump displacement through a traditional method of porting oil to a servo piston based on a pressure balance and spring setting.

Figure 2:
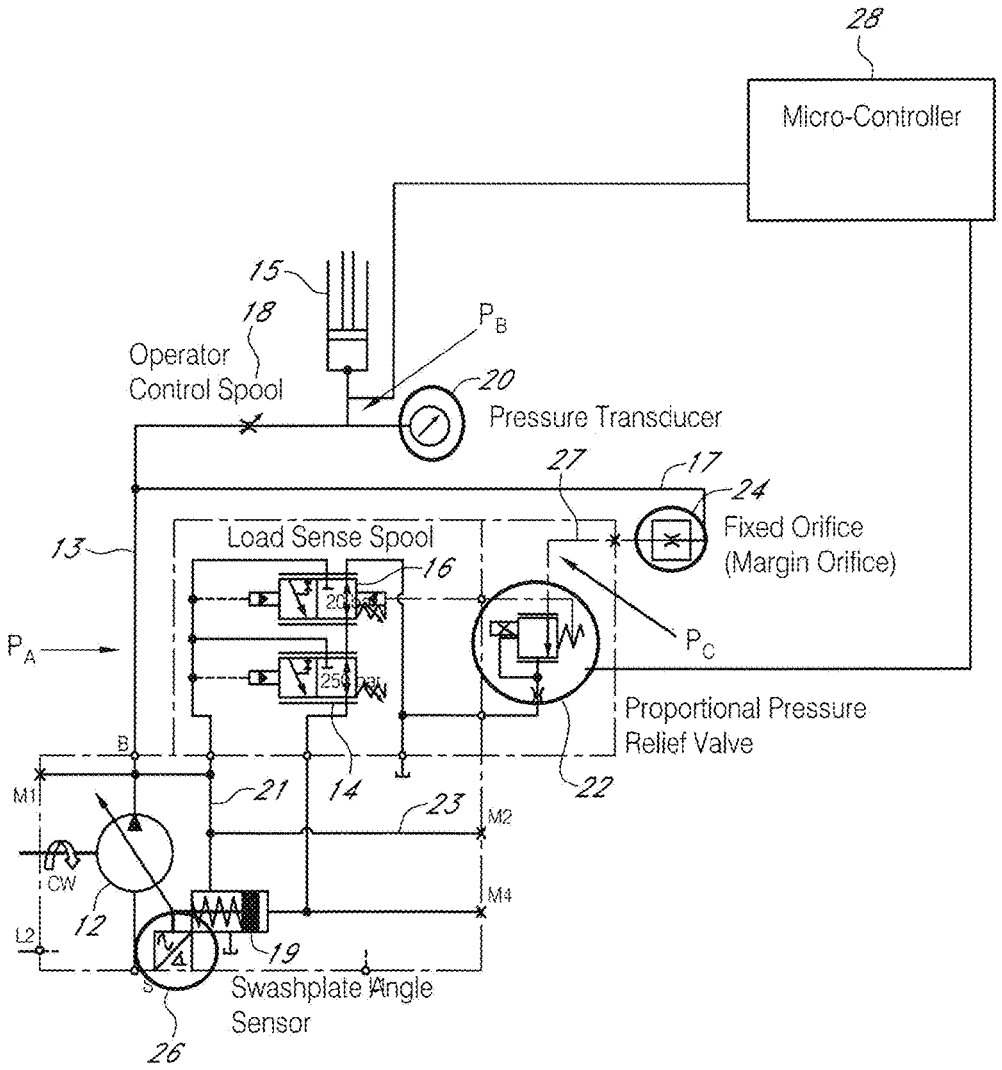
FIG. 2 is a schematic view of a pressure control load sense system.

To add benefits to this system, as shown in FIG. 2, a pressure transducer 20, a proportional pressure relief valve 22, a fixed orifice 24, and an angle sensor 26 are added. The proportional pressure relief valve 22 is added to the control of the pump 12 while the load sense port of the pump 12 is routed through the orifice 24 instead of routing to the resolved load sense pressure port in the valve 22, which is usually located at load pressure (PB), directly to the pump outlet either outside the pump 12, at the pump outlet pressure (PA) or internally in the control spool of the pump 12. The pressure at load (PB) is communicated to a micro-processor 28 that turns the load pressure (PB) into a corresponding current which is sent to the proportional pressure relief valve 22. The proportional pressure relief valve 22 then relieves the pressure so that pressure PC in flow line 27 is equal to the load pressure (PB). The pump margin pressure as set by the load sense spool 16 in the pump control is satisfied across the fixed orifice (margin orifice) 24. The micro-processor 28 constantly makes current adjustments so that pressure PC is always equal to load pressure (PB). Simultaneously, the margin setting is concurrently satisfied across the margin orifice 24 and the operator control spool 18. Additionally, by measuring temperature at the proportional pressure relief valve 22 and adjusting current in relation to pressure a more consistent performance over a broad temperature range is maintained.

Figure 3:
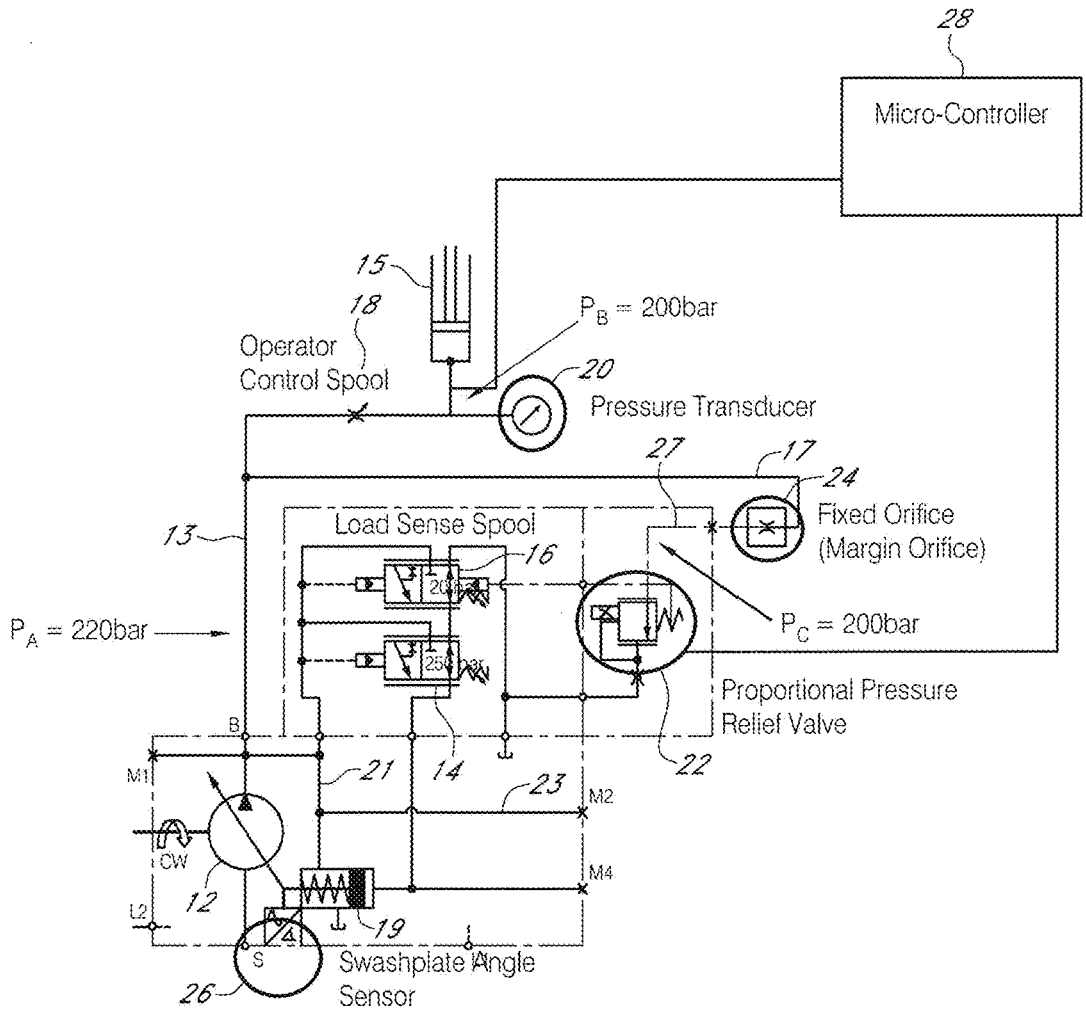
FIG. 3 is a schematic view of a pressure control load sense system.

The pressure in the system is created by the resistance of the load with the flow provided by the pump 12. As an example only, and shown in FIG. 3, the load pressure (PB) is 200 bar, which is replicated by the micro-processor 28 and proportional pressure relief valve 22 so that the pressure at PC is also equal to 200 bar. The 20 bar spring setting in the load sense spool 16 strokes the pump 12 to maintain the pump outlet pressure (PA) at 20 bar higher pressure so that pump outlet pressure (PA) is equal to 220 bar. If the load encounters a different pressure, the different pressure is communicated to the micro-processor 28, which adjusts the pressure at PC, and the pump displacement adjusts to maintain the load sense spool 16 setting. When an operator changes the operator control spool 18, pressure at the load (PB) changes, and the system adjusts as it would with a normal PCLS (Power Control Load System) system.

As shown, the electronic load sense system 10 replicates the pressure in the load sense port of the pump 12 that is seen at the resolved load sense port, and normally communicated to by a hydraulic load sense line. By replicating the pressure in the load sense port, the margin across the operator control spool 18 is equal to the margin across the margin orifice 24 which is the same as the margin spring setting in the pump 12.

Figure 4:
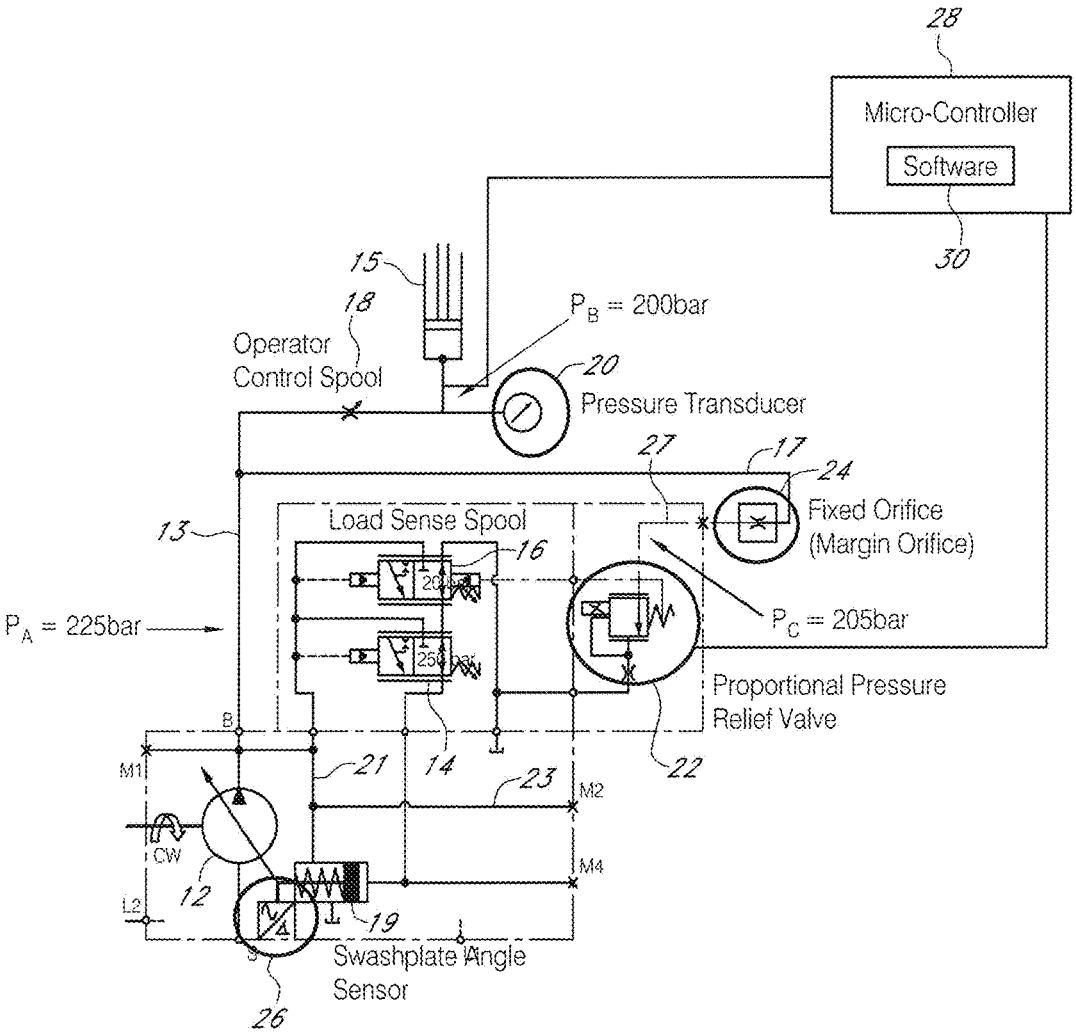
FIG. 4 is a schematic view of a pressure control load sense system.

Utilizing software logic 30 an electronically variable working margin can be realized by a slight change or offset of the resolved load sense pressure instead of replicating the resolved load sense pressure. As an example only, and shown in FIG. 4, the load pressure (PB) is 200 bar. Instead of replicating pressure in PC to be exactly equal to the 200 bar load, the software logic 30 adds 5 bar to the setting so that the pressure in PC is now equal to 205 bar. The load sense spool 16 will maintain a 20 bar margin between the pressure at pump outlet (PA) and PC, such that the pump 12 will be stroked until the outlet pressure is equal to 225 bar. The load sense spool 16 maintains a spring setting of 20 bar at the margin orifice 24 ((PA)-PC), while the real working margin across the operator control spool 18 is 25 (PA)-(PB). As a result, an operator will experience more flow through the valve at a given flow command and experience additional flow above what was originally available when the spool is at maximum displacement.

Figure 5:
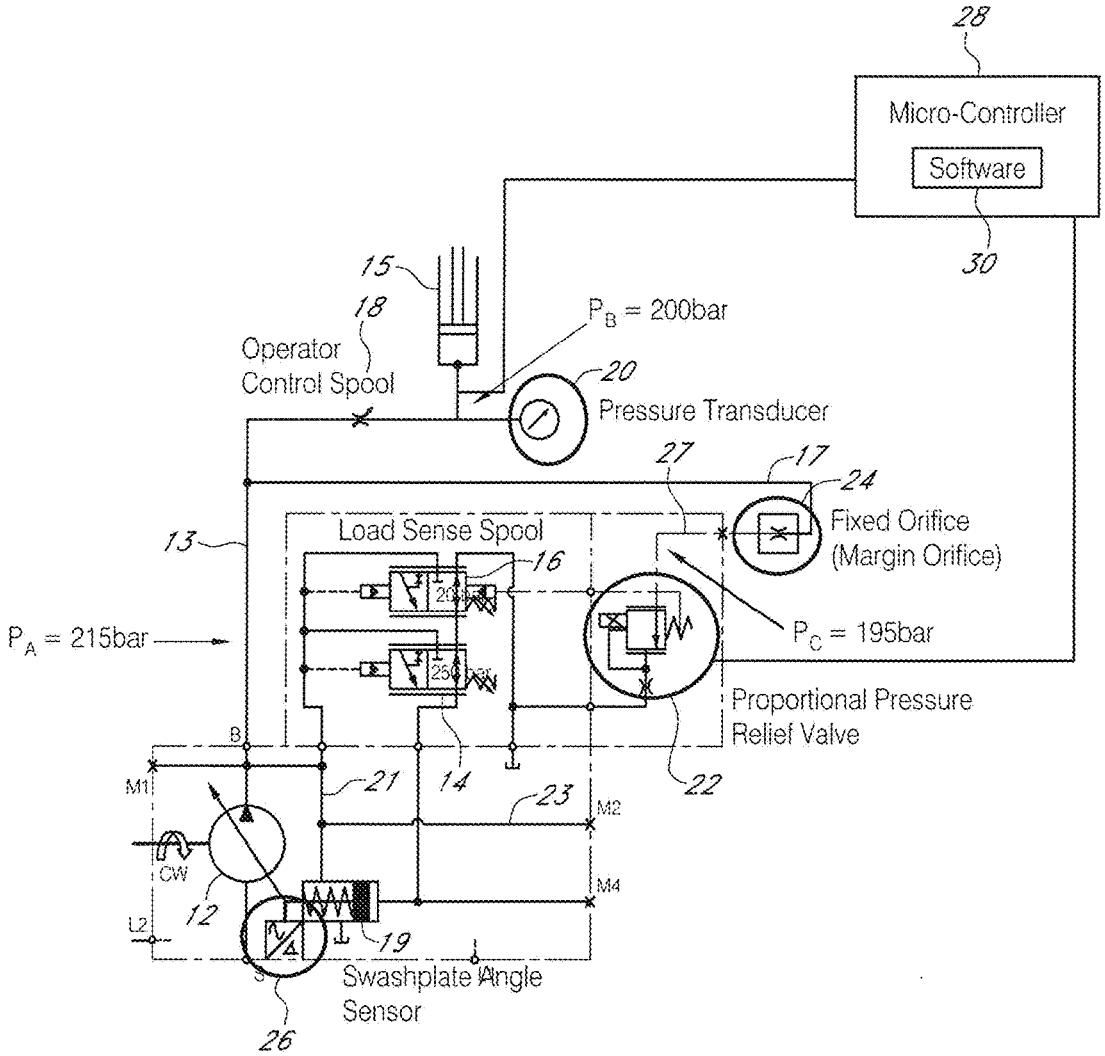
FIG. 5 is a schematic view of a pressure control load sense system.

In another example, as shown in FIG. 5, the pressure at load (PB) is at 200 bar. The software logic 30 subtracts 5 bar from the setting so that pressure in PC is equal to 195 bar. Here, the load sense spool 16 will maintain a 20 bar margin between pressure at pump outlet (PA) and PC such that the pump will be stroked until the outlet pressure is equal to 215 bar. The margin across the operator control spool 18 is now 15 bar (PA)-(PB) compared to the margin across margin orifice 24 which is 20 bar ((PA)-PC). For any spool setting that is decreased, an operator will experience less flow through the valve for a given flow command. This mode of operation saves energy due to the reduced pressure drop across the operator control spool 18. Proportionally, more of the pump outlet pressure (PA) is available to do work by lifting the 200 bar load with 215 bar of pump outlet pressure (PA) versus a pump outlet pressure of 220 bar as previously required.

To have an operating envelope larger than a traditional system, one need only take advantage of both high and low margin settings or rely on margin settings that continuously vary between high and low. With low operator spool commands, a lower working margin could be maintained which would save energy. As the operator control spool demand increases, the working margin pressure would increase, offering more flow for a given spool setting. In one embodiment, this is done automatically with software algorithms or with operator interactive controls.

To increase the stability of the system, and improve overall system performance, some level of flow dependency is placed on the pressure of the working function to dampen the system. This improves upon the state of the art where PCLS system controls are very rigid against changes in load systems, which can be the prime driver of system instabilities.

Figure 6:
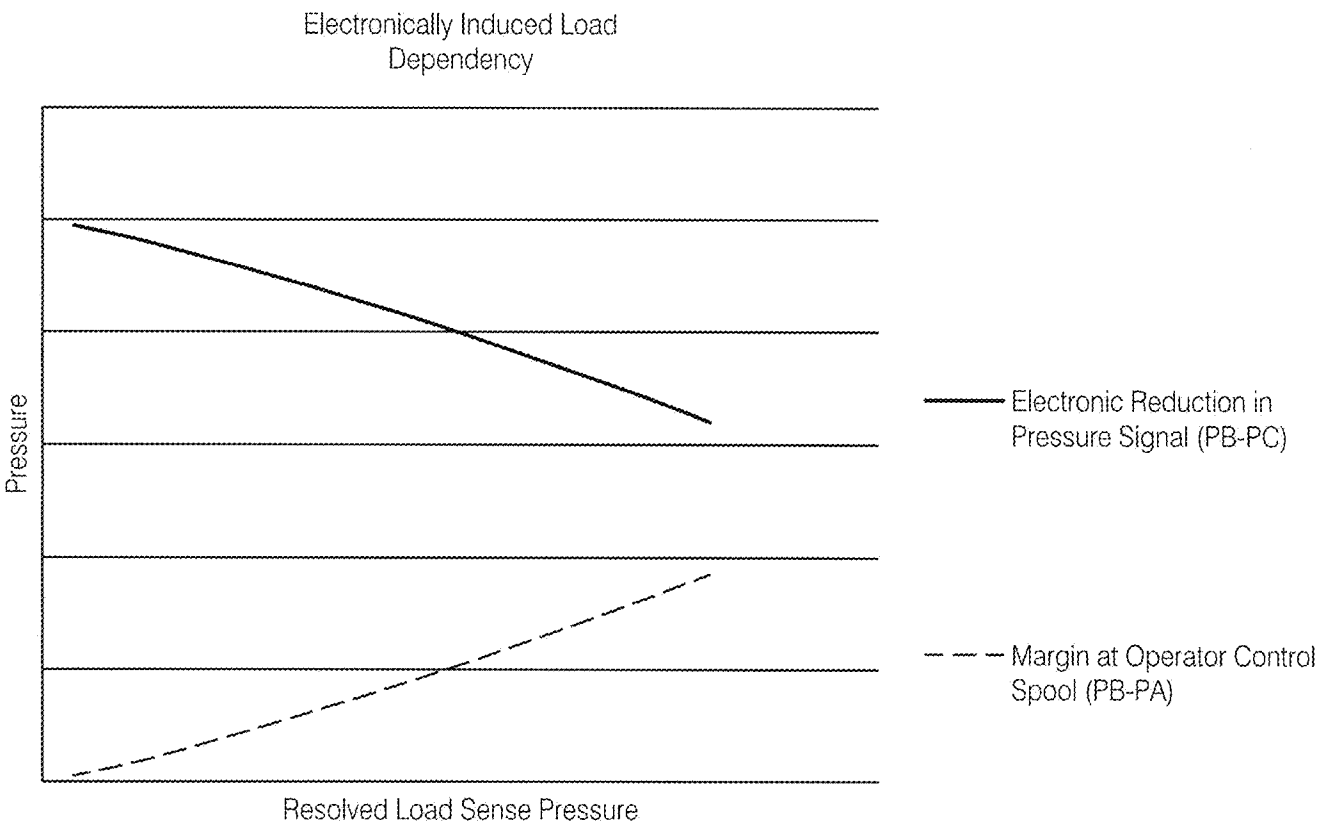
FIG. 6 is a chart showing pressure compared to resolved load sense pressure.
Figure 7:
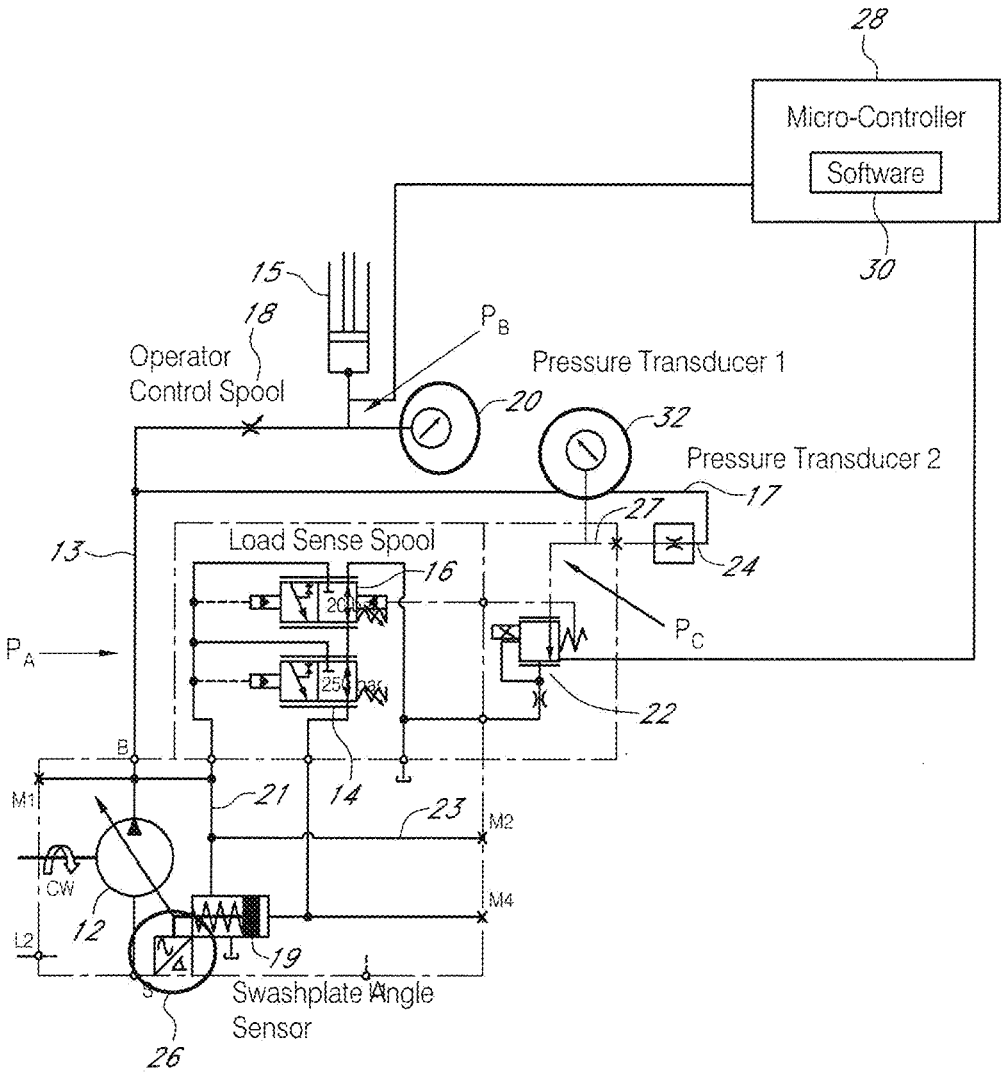
FIG. 7 is a schematic view of a pressure control load sense system.

To accomplish this, the micro-processor 28 slightly modifies the pressure that is replicated at PC in relation to what is being measured at (PB) as shown by example in FIG. 6. As resolved load sense pressure is increased, the margin across the operator control spool 18 is reduced such that PC would be lowered in relation to (PB) as the absolute value of (PB) increased. Thus, for a given constant operator command, as the load pressure (PB) increased the effective working margin at the operator control orifice would decrease leading to a decrease in flow for a given function. The slight reduction in flow would act as a dampening function for the system 10. For the reduction in flow to not interfere with machine productivity or cause a negative perception by machine operators, the system would need to be tuned.

Where slight variation occurs between pressure measured at (PB) and pressure generated at PC due to changes in temperature, a second pressure transducer 32 is used near the margin orifice 24 associated with flow line 27 as shown by example in FIG. 7. By measuring the pressure at PC, a closed loop algorithm is used to ensure that the pressure relationship required by the control algorithm is accurately reproduced.

Often, with load sensing open circuit systems, the torque requested to be supplied by the engine exceeds the engine's capabilities. When this happens, the operator reduces his command which slows the machine and makes the machine difficult to operate efficiently, or the engine simply stalls requiring restarting of the machine. Also, when high flows and pressures are commanded of the pump 12, the torque requirement placed on the prime mover exceeds capabilities resulting in a stalled engine. To avoid these situations an electronic variable torque control is used such that output pressure of the pump 12 is equal to the required pressure to lift the load plus the drop across the operator control spool 18.

To accomplish this, first the input torque to the pump 12 that must be supplied by the engine is calculated by the micro-computer 28 by taking the product of the output pressure (PA) of the pump 12 and the displacement required to maintain the LS pressure drop across the orifice 24. A sample of the calculation is shown below:

Pump Torque=200 bar×45 cc/rev/62.8×100=143.31 Nm where the pressure required to lift a load is equal to 180 bar and the resultant output pressure (PB) of the pump 12 is equal to 200 bar. When resistance to the circuit is encountered that raises the force on a cylinder 15 the resultant pressure in the circuit will increase. With no change in the valve command, the pump 12 will attempt to maintain the same output flow at the higher pressure. For example, where load pressure required is equal to 300 bar and output pressure at the pump is 320 bar:

Pump Torque=320 bar×45 cc/rev/62.8×100%=229.30 Nm

If the engine on the machine is only capable of 150 Nm of output torque, this new load and sustained flow command would overwhelm the engine and result in a stalled condition if the operator continued the command. Using the electronic torque control the system can control the stroke of the pump 12 by regulating the LS pressure PC in the control while maintaining a torque level at or below the maximum torque that the engine can provide keeping the engine from stalling.

Figure 8:
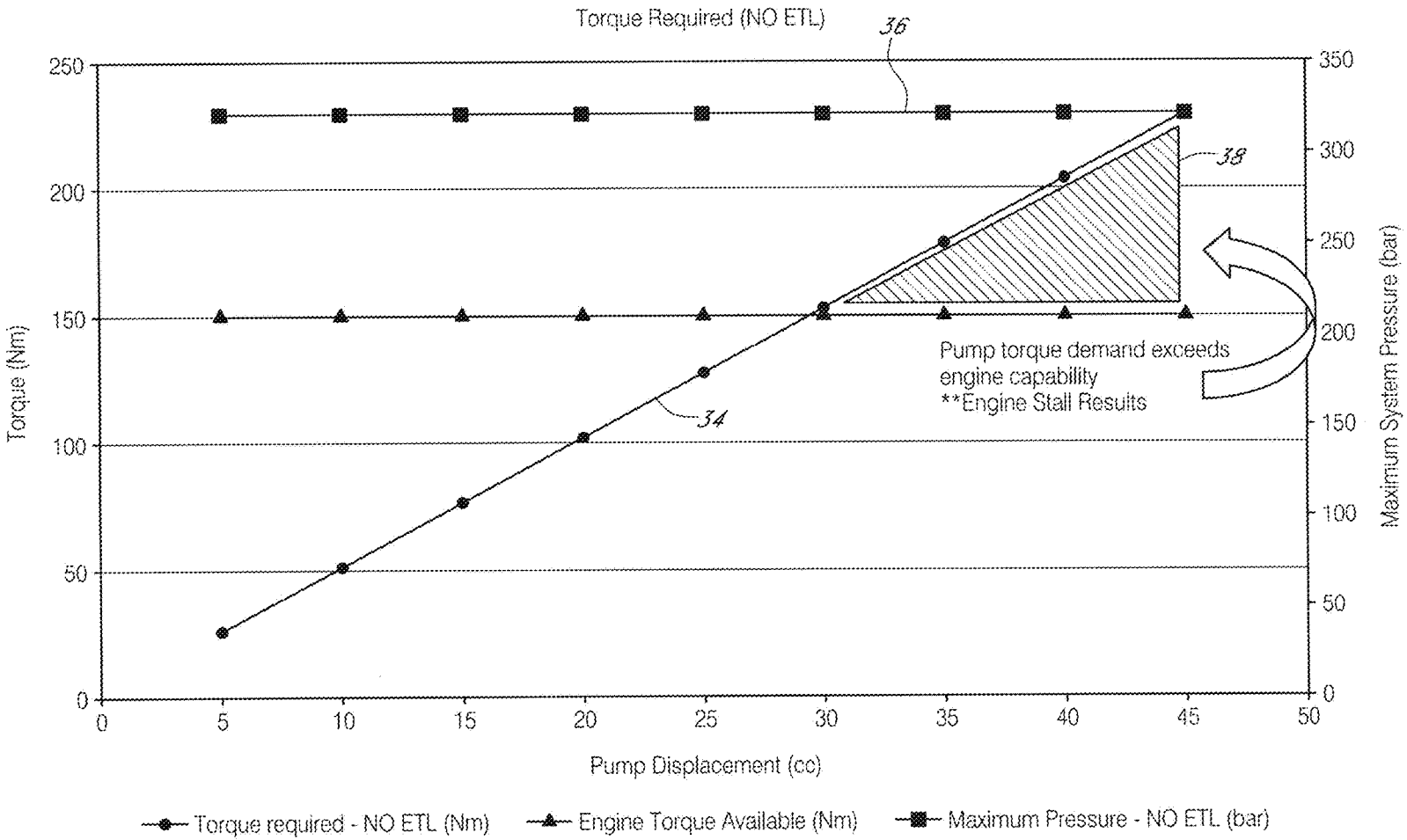
FIG. 8 is a chart showing pump displacement compared to torque required.
Figure 9:
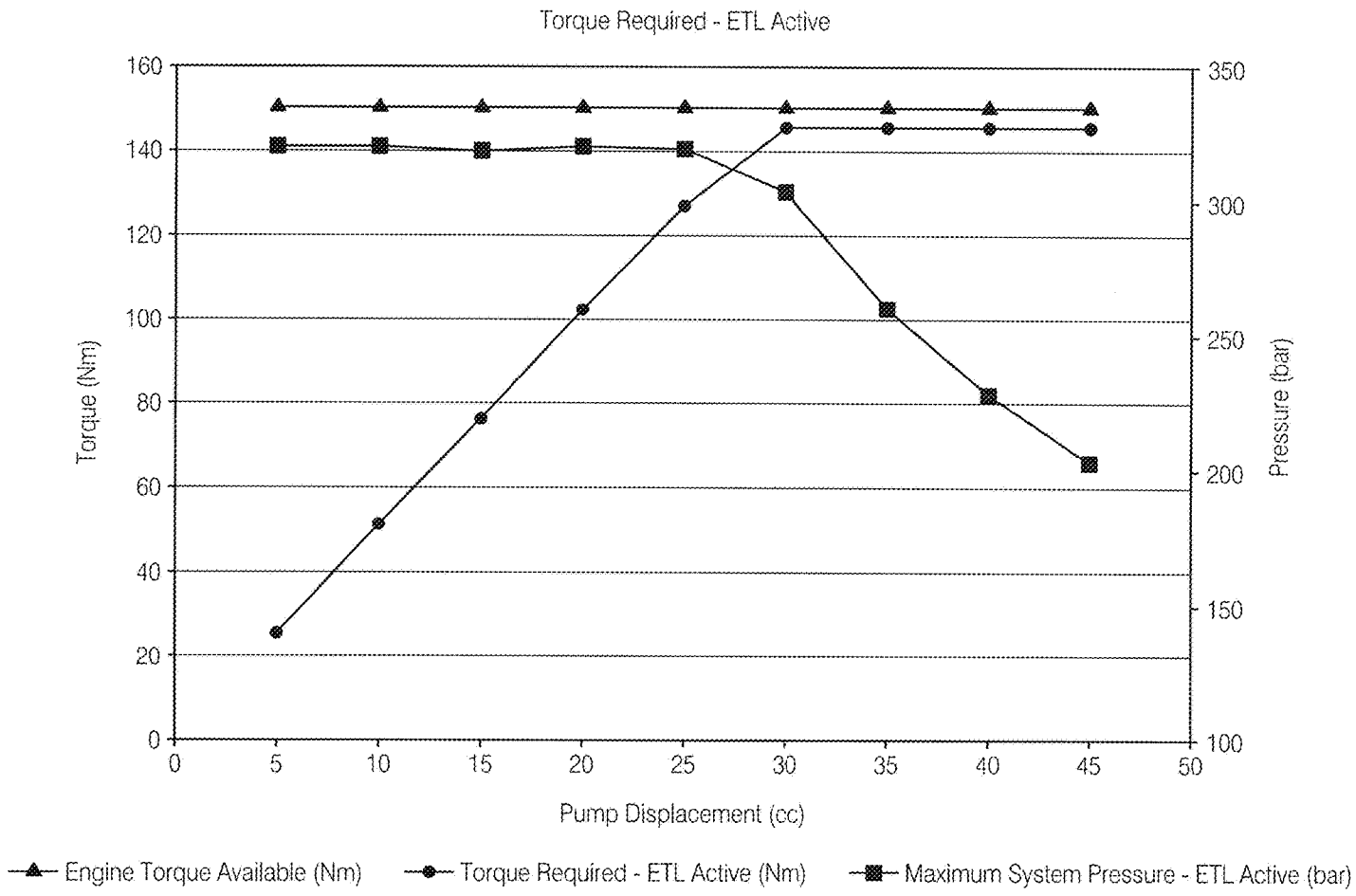
FIG. 9 is a chart showing pump displacement compared to torque required.

As shown in FIG. 8, based on the previous example, there is a large area in which the pump 12 is capable of operating that would result in an engine stall condition. Line 34 shows the maximum torque level that the engine is capable of delivering to the pump. Line 36 shows the constant maximum pressure limit usually employed with a traditional load sense system. During operation, the software 30 is continually monitoring the angle of the swash plate using the swashplate angle sensor 26 in the pump 12. Swash plate angle is used to calculate a maximum pressure that would result in a torque level that the engine could produce at a given displacement and the correct current is sent to the proportional pressure reliving valve 22 in the pump control to achieve the maximum pressure at PC. Using control logic 30, electronic torque limiting is able to prevent operation in area 38 that results in engine stall, and instead allows the hydraulic system to always deliver maximum possible pressure for a given displacement without engine stalling.

The system also provides an electronic load sense relief. Since the proportional pressure relief valve 22 is limiting the pressure seen by the pump control, it can also take the place of other load sense relief valves in the system. Even if load pressure (PB) spikes to an undesirable level, the micro-controller 28 can maintain the pressure relief setting being sent to the relief valve to a limited pressure and the pump 12 will de-stroke until the pump outlet pressure (PA) reaches a desirable level.

Thus an electronic sense control has been disclosed that at the very least meets all the stated objectives.

What is claimed is:

1. An electronic load sense control system, comprising;

a pump connected in line to an operator control spool valve, a pressure compensation spool valve, and a load sense spool valve;

a first sensor connected between the pump and the operator control spool valve for measuring pump outlet pressure;

a second sensor connected between an actuator and the operator control spool valve for measuring pressure at load;

a load sense port of the pump is routed through a fixed orifice to a proportional pressure relief valve; and a micro-processor connected to the first sensor, the second sensor and the proportional pressure relief valve.

2. The system of claim 1 wherein the micro-processor is configured to turn a sensed load pressure into a corresponding current sent to the proportional pressure relief valve, which is configured to relieve pressure so that pressure between the fixed orifice and the proportional pressure relief valve are equal to the sensed load pressure.

3. The system of claim 2 wherein the current is adjusted based upon temperature sensed at the proportional pressure relief valve.

4. The system of claim 1 wherein the micro-processor includes software logic is configured to calculate an offset of a resolved load sense pressure to create a variable working margin.

5. The system of claim 4 wherein the software logic adds to the resolved load sense pressure.

6. The system of claim 4 wherein the software logic subtracts from the resolved load sense pressure.

7. The system of claim 1 further comprising a first and a second pressure transducer.

8. The system of claim 1 further comprising a swashplate angle sensor.

9. The system of claim 8 wherein the micro-processor is configured to calculate input torque based upon sensed pressure at pump outlet and displacement required to maintain load sense drop at the fixed orifice.

10. The system of claim 8 wherein the micro-processor is configured to calculate maximum pressure between the fixed orifice and the proportional pressure relief valve based upon constant monitoring of the swashplate angle.

* * * * *